US005127349A

United States Patent [19]

Nakamura et al.

[11] Patent Number: 5,127,349

[45] Date of Patent: Jul. 7, 1992

[54] SEWING MACHINE

[75] Inventors: Satoshi Nakamura; Hideo Asao, both of Tokyo, Japan

[73] Assignee: Juki Corporation, Tokyo, Japan

[21] Appl. No.: 518,518

[22] Filed: May 3, 1990

[30] Foreign Application Priority Data

May 17, 1989 [JP] Japan ..... 1-123839

[51] Int. Cl.[5] ..... D05B 35/08

[52] U.S. Cl. ..... 112/121.27; 112/147

[58] Field of Search ..... 112/121.27, 121.12, 112/121.26. 144, 147, 152, 2, 136

[56] References Cited

U.S. PATENT DOCUMENTS

| | | | |
|---|---|---|---|
| 4,079,682 | 3/1978 | Nishiwaki | 112/144 X |
| 4,425,858 | 1/1984 | Hargett | 112/121.12 |
| 4,577,571 | 3/1986 | Carson | 112/121.27 |
| 4,606,287 | 8/1986 | Papajewski et al. | 112/121.27 |
| 4,699,302 | 10/1987 | Papajewski et al. | 112/121.27 |

*Primary Examiner*—Peter Nerbun

*Attorney, Agent, or Firm*—Tarolli, Sundheim & Covell

[57] ABSTRACT

A sewing machine includes a base, a sewing device installed on this base to sew material, and a pair of material setting/transfer assemblies provided on the base. Each material setting/transfer assembly comprises a sewing portion setting mechanism fixed on the base which is able to position portions of the material to be sewn including tucking ends; a transfer mechanism mounted on the base movably between this sewing portion setting mechanism and the sewing device; and a tuck-in mechanism movably attached on the base for approaching to and retreating from the sewing portion setting mechanism. The tuck-in mechanism serves to fold the tucking ends in for forming the portions to be sewn into tucked sewing portions in cooperation with the sewing portion setting mechanism, so that the transfer mechanism continues to hold these tucked sewing portions together with the tuck-in mechanism until, at least, the tucked sewing portions are released from the sewing portion setting mechanism for enabling the transfer mechanism to carry the tucked sewing portions to the sewing device.

11 Claims, 20 Drawing Sheets

FIG. 16a
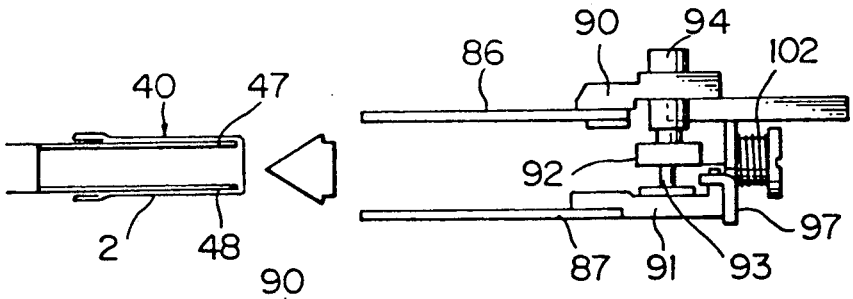
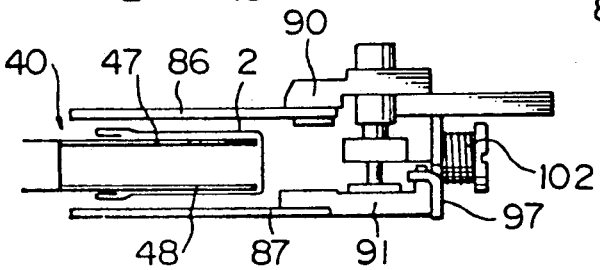
FIG. 16b
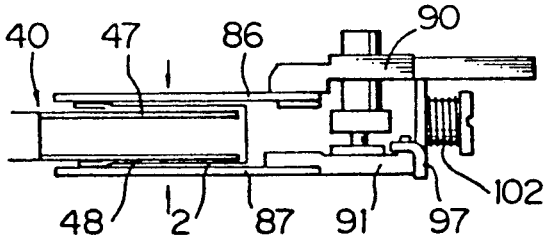
FIG. 16c

SEWING MACHINE

BACKGROUND OF THE INVENTION

1. Field of the Invention

The present invention relates to an improvement of a sewing machine, more particularly of a sewing machine which tucks in tucking ends of sewing materail, transfers these tucked portions, and sews them.

2. Description of the Prior Art

In order to sew portions of material to be sewn including tucking ends, it is generally known that the tucking ends are first tucked in, and these tucked sewing portions are then transferred to a sewing device for sewing them.

For example, as shown in FIGS. 1 and 3, a waist belt 2 of jeans 1 is sewn on a body 3 in the following way. First, a long, narrow strip of material for forming the waist belt is folded double with its lower edges being turned in, and the entire periphery of the waist of the body 3 is inserted between these double folds. Then, an upper section of the waist belt 2 and a section where the waist belt 2 is superposed on the body 3 are sewn with thread 4, 5, respectively. In such a condition as illustrated in FIG. 1, both end portions of the waist belt 2 at the front of the jeans remain as portions to be sewn 2*a*, with tucking ends 2*b* which are not yet sewn extending from the end portions of the body 3 where a fastener 6 is attached.

For sewing each portion to be sewn 2*a* of the above waist belt, the tucking end 2*b* is first tucked into the inside of the waist belt 2 along the direction indicated by the arrows in FIG. 3. In this case, this tucked portion is such that it extends beneath the portion to be sewn 2*a* of the body 3 for forming a tucked sewing portion 7. A side edge 8 of this tucked sewing portion is arranged to be parallel with a side end 9 of the body 3. Then, the border of the tucked sewing portion 7 is sewn with sewing thread 10 over a U-shaped sewing sewing region which is denoted by a reference numeral 11 in FIG. 3. Thus, the waist belt is sewn onto the body so as to complete the jeans.

Conventionally, tucking the tucking ends of such a waist belt 2, transferring the tucked sewing portions to the sewing device, and sewing these tucked portions have been done by hand.

However, when the tucking, transferring, and sewing operations are performed by hand as mentioned above, there have been caused such problems that the operations are not only complicated but also tediously long in being performed. In addition, there has been caused another problem that these operations require a high level of skill, which inevitably results in an increase in the cost of such clothing articles. Because the material is very heavy duty, the tucking operations for jeans is extremely difficult, and there has been a resultant labor problem that the operators suffer from inflammation of the tendon sheaths, etc.

The present invention intends to solve the problems inherent in the conventional performance of such operations as described above by providing a sewing machine which can automatically perform the tucking, transferring, and sewing operations.

SUMMARY OF THE INVENTION

In order to solve the above-stated problems, according to one aspect of the present invention, there can be provided a sewing machine including a base, a sewing device installed on this base to sew material, and setting/transfer means for sewing material, and setting/-transfer means for sewing material, wherein these material setting/transfer means include a mechanism fixed on the base which is adapted to position portions of the sewing material having tucking ends; transfer means mounted on the base movably between this positioning mechanism and the sewing device; and a tuck-in mechanism movably attached on teh base for approaching to and retreating from the positioning mechanism, this tuck-in mechanism being arranged for forming the portions to be sewn into tucked sewing portions in cooperations with the positioning mechanism, so that the transfer mechanism will hold the tucked sewing portions while the transfer means carry the tucked sewing portions to the sewing device.

The present invention further includes a material supporting mechanism, which is able to support the sewing material as a whole.

This material supporting mechanism is provided with support faces whose configurations can be adjusted to correspond to a form of the material to be sewn.

Furthermore, according to another aspect of the present ivnention, an improved automatized tucked and sewing machine can be obtained. This machine includes a base, a sewing device installed on this base to sew material, and a pair of material setting/transfer assemblies provided on the base. Each material setting/transfer assembly comprises a sewing portion setting mechanism fixed on the base which is able to position portions of the material to be sewn including tucking ends; a transfer mechanism mounted on the base movably between this sewing portion setting mechanism and the sewing device; and a tuck-in mechanism movably attached on the base for approaching to and retreating from the sewing portion setting mechanism, and this tuck-in mechanism folds the tucking ends in for forming the portions to be sewn into tucked sewing portions in cooperation with the sewing portion setting mechanism, so that the transfer mechanism continues to hold these tucked sewing portions together with the tuck-in mechanism until, at least, the tucked sewing portions are released from the sewing portion setting mechanism, thereby enabling the transfer mechanism to carry the tucked sewing portions to the sewing device.

A pair of material setting/transfer assemblies serve to automatically tuck the tucking ends of a waist belt, and transfer and sew these tucked sewing portions.

First, portions of material to be sewn including the tucking ends are set on a sewing portion setting mechanism. In this case, it is desirable to support the sewing material as a whole by means of a material supporting mechanism.

A tuck-in mechanism tucks the tucking ends of the waist belt in cooperation with the sewing portion setting mechanism. A transfer mechanism holding these tucked ends or the tucked sewing portion transfers them to a sewing device. Then, the tucked sewing portions are sewn by the sewing device.

BRIEF DESRIPTION OF THE DRAWINGS

Figure 13:
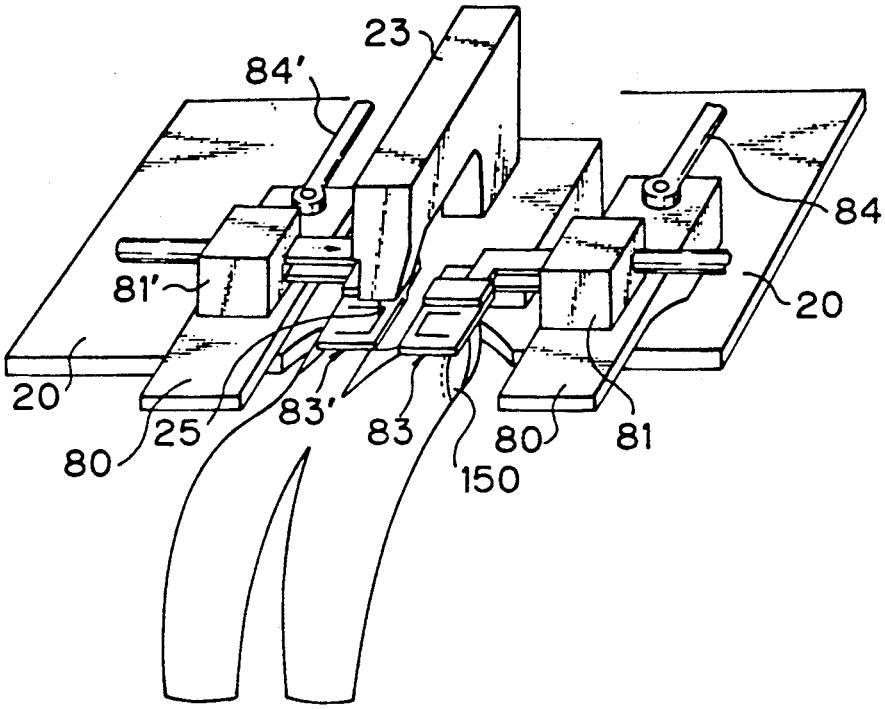
Figure 14:
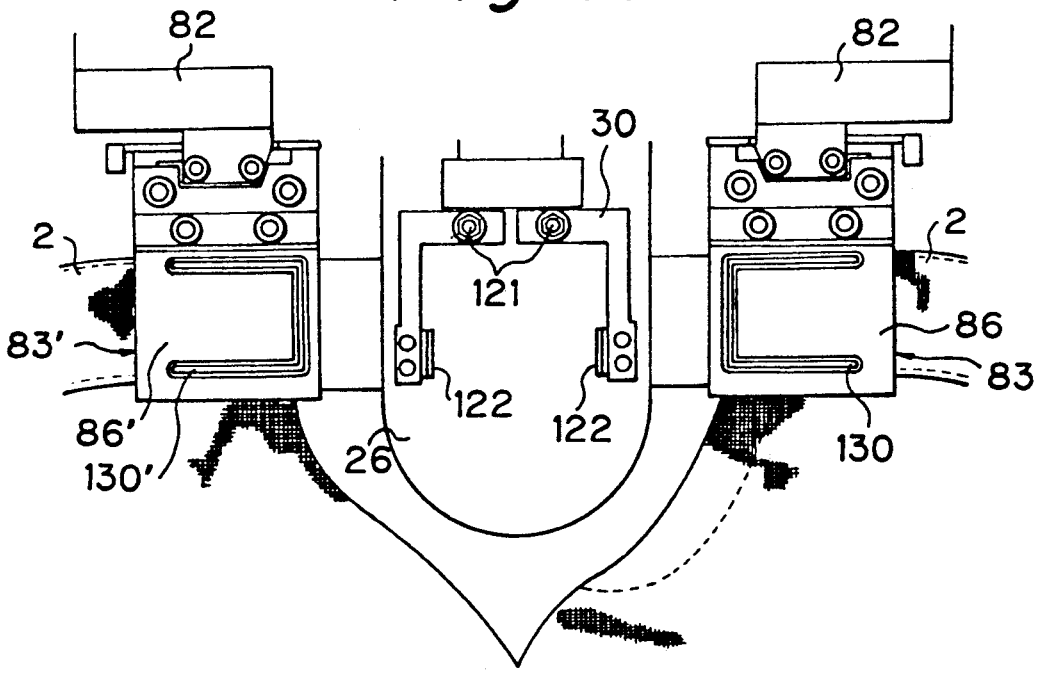
Figure 15:
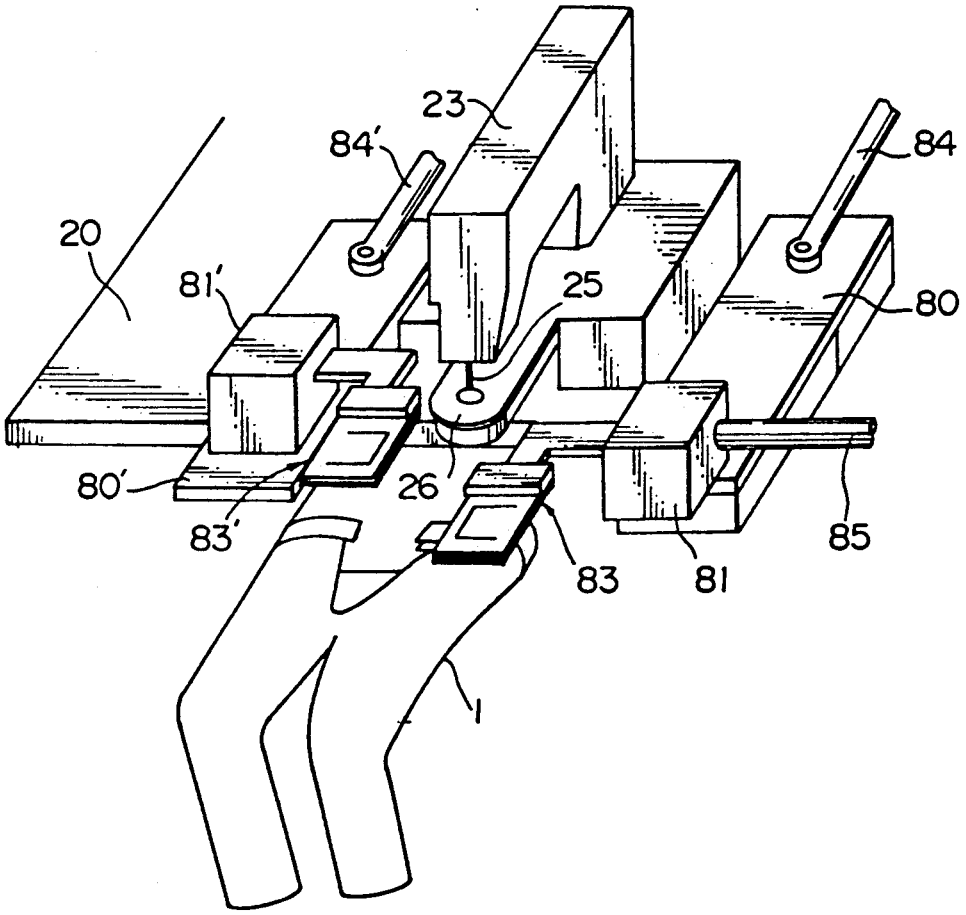
Figure 18:
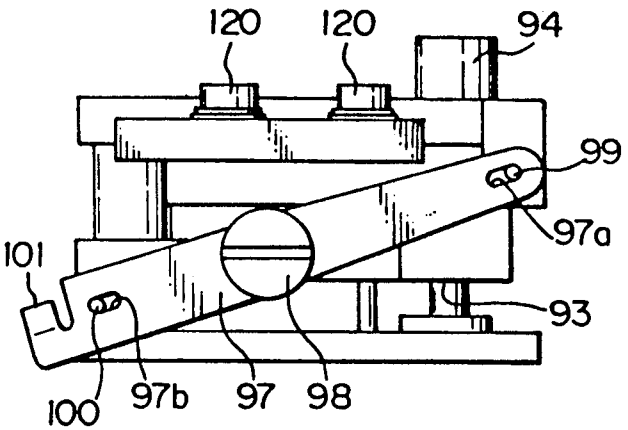
Figure 17:
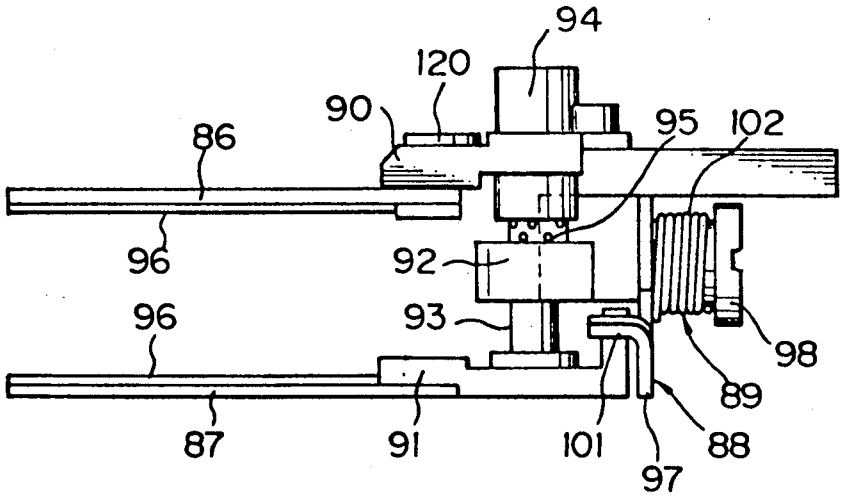
Figure 19:
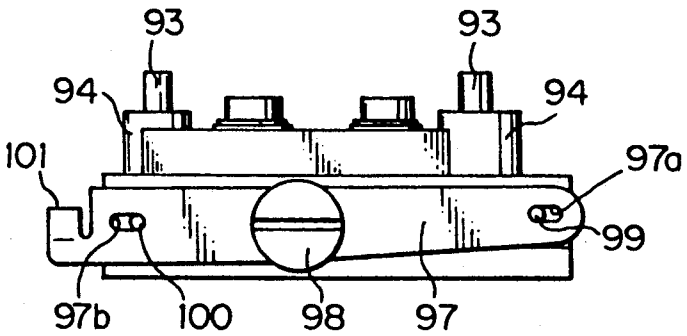
Figure 20:
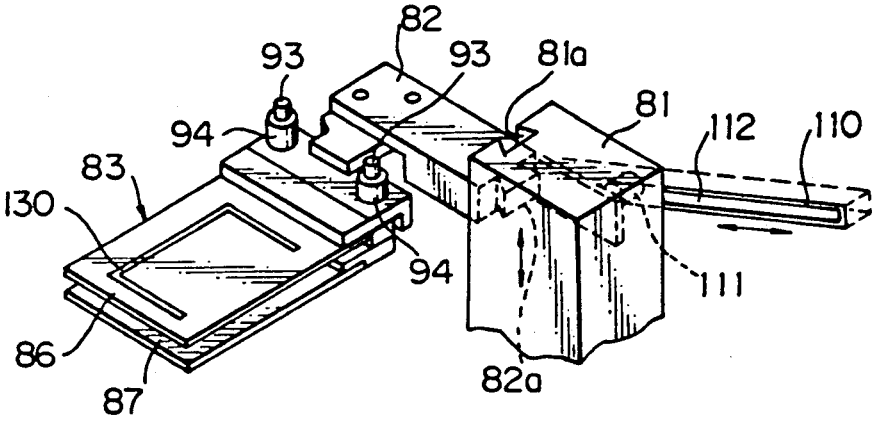
Figure 21:
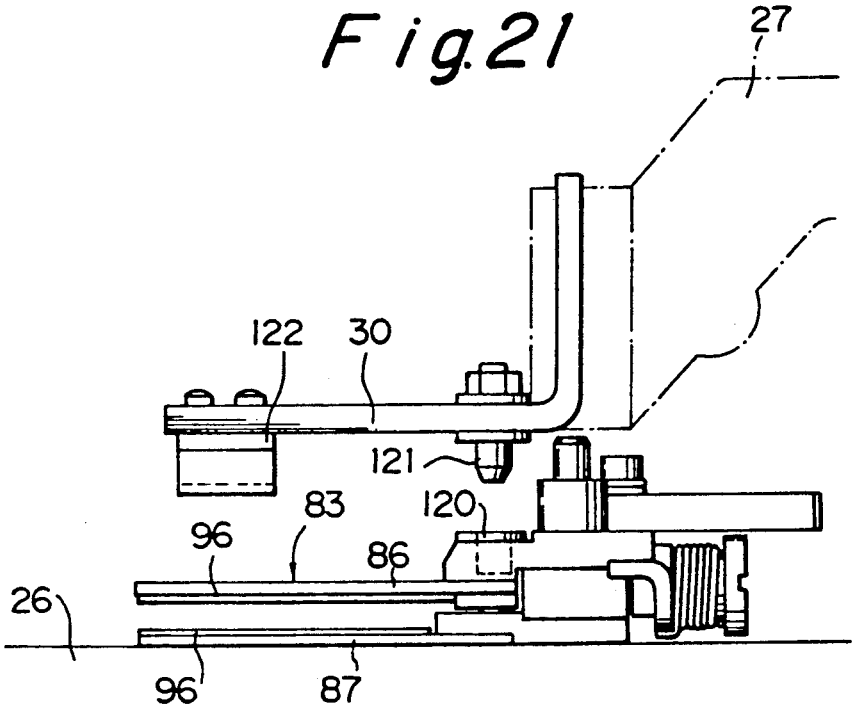
Figure 22:
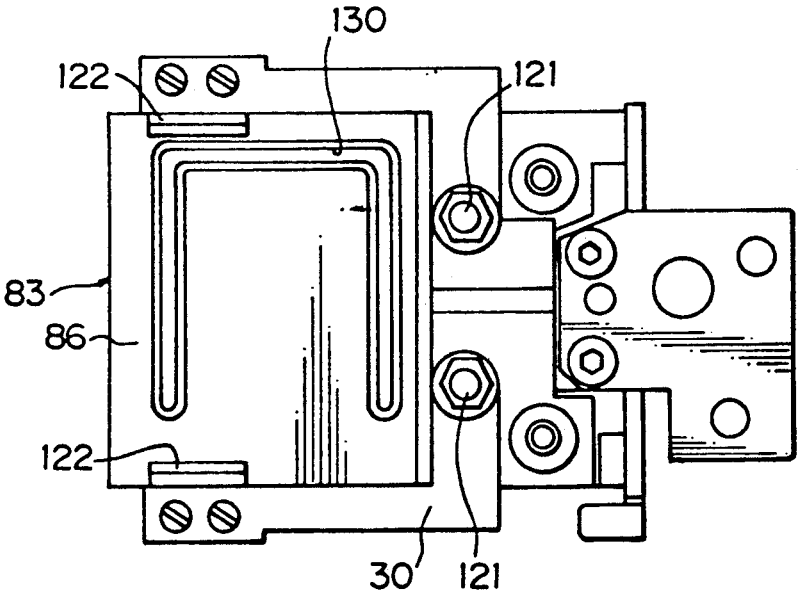
Figures 23, 24, 25:
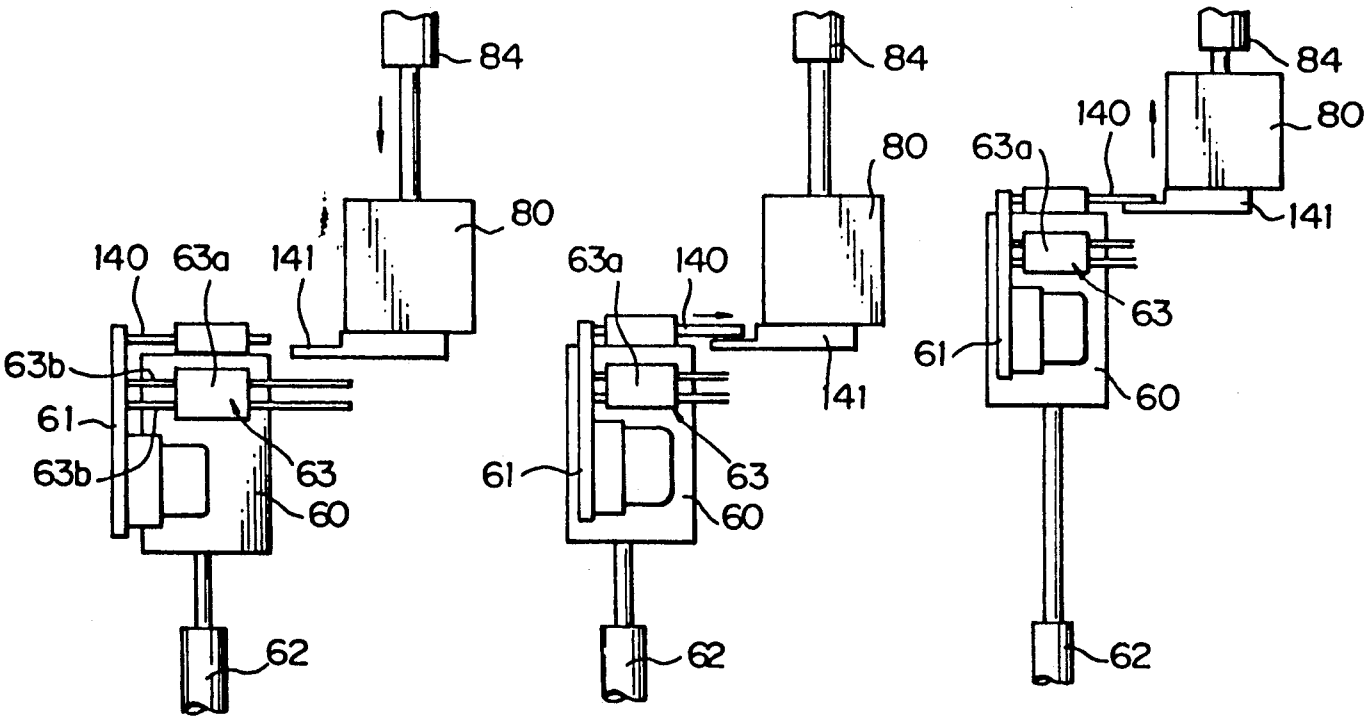
Figure 26:
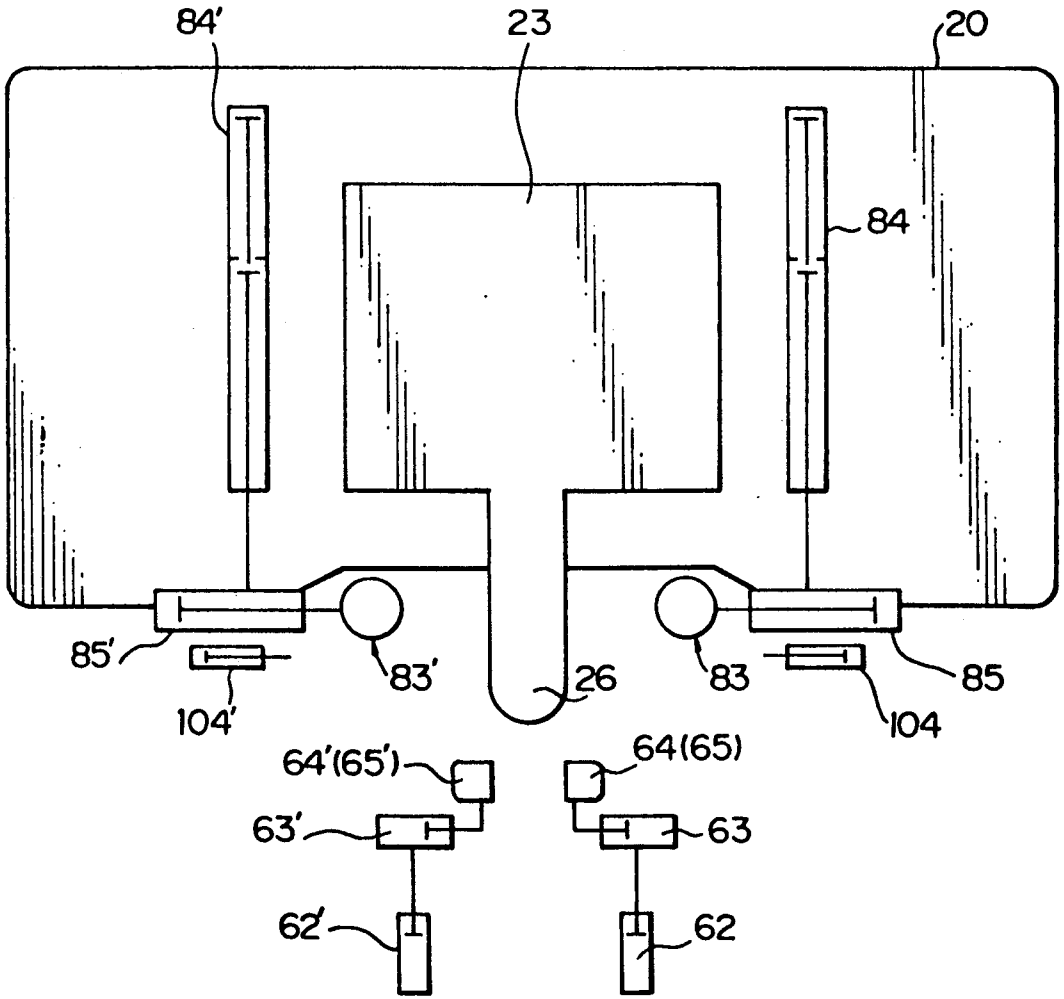

FIGS. 11*a* to 11*d*, 11*a*-1, 11*b*-1 and 11*d*-1 are explanatory views showing the operation of a tuck-in mechanism;

FIGS. 12*a* to 12*d* are explanatory views showing the tucking processes corresponding to FIGS. 11*a* to 11*d*;

FIG. 13 is a perspective view showing one of the holding cassettes placed on a needle plate for sewing;

FIG. 14 is a plane view of the right and left holding cassettes positioned on both sides of the needle plate;

FIG. 15 is a perspective view showing the sewing machine of the present invention with one of the holding cassettes pressing the tucking end and the other holding cassette being positioned away from the tucking end;

FIG. 16*a* to 16*c* are explanatory views showing the order of the holding cassette;

FIG. 17 is a side view of the holding cassette when an upper holding plate and a lower holding plate are open;

FIG. 18 is a back view of the holding cassette in FIG. 17;

FIG. 19 is a back view of the holding cassette when the upper holding plate and the lower holding plate are open;

FIG. 20 is a perspective view showing a guide mechanism of the holding cassette;

FIG. 21 is a side view of the holding cassette placed on the needle plate;

FIG. 22 is a plane view of the holding cassette in FIG. 21;

FIGS. 23 to 25 are plane views respectively showing follow-up means located between the tuck-in mechanism and the transfer mechanism;

FIG. 26 is a plane view showing the locations of air cylinders; and

Figure 27:
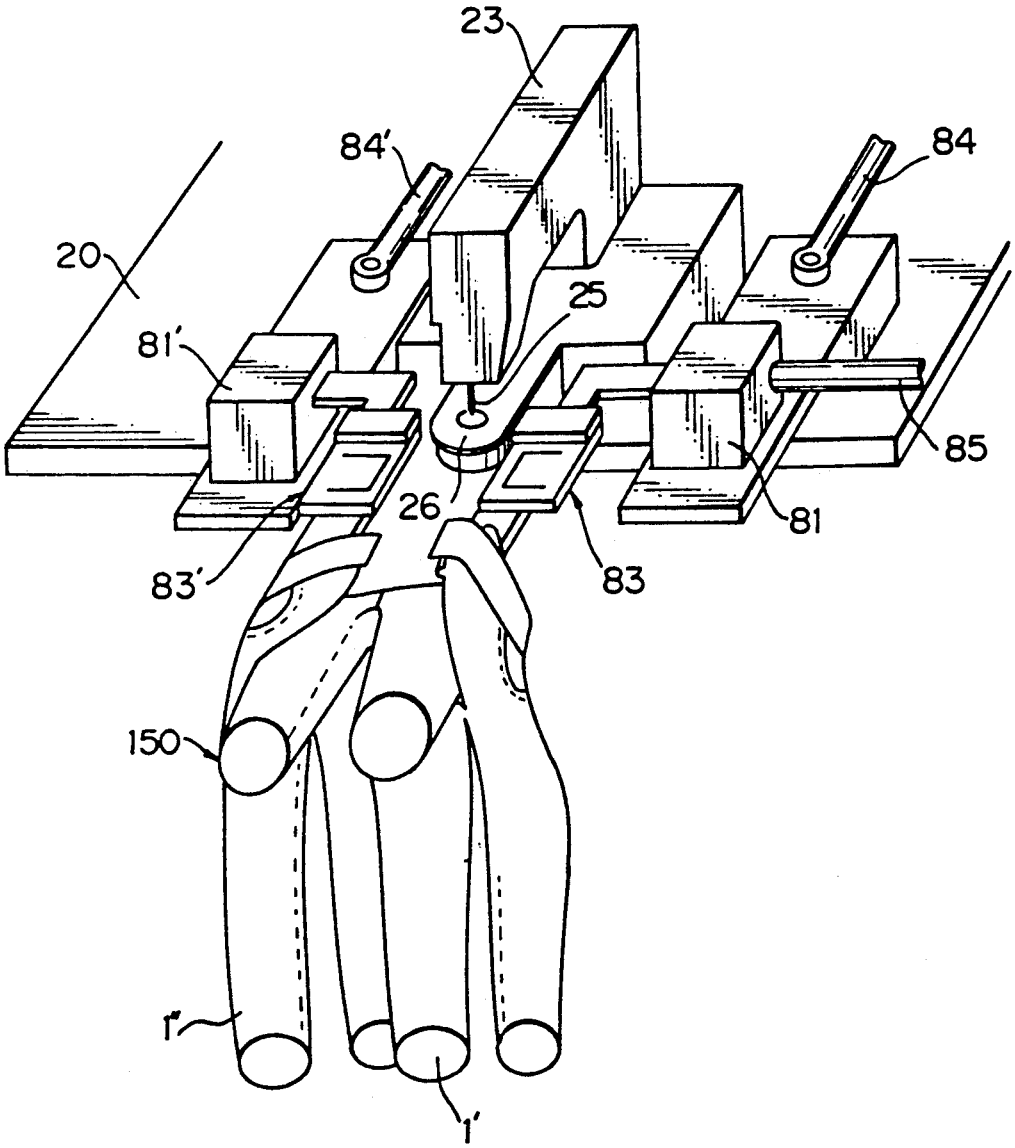
Figure 28:
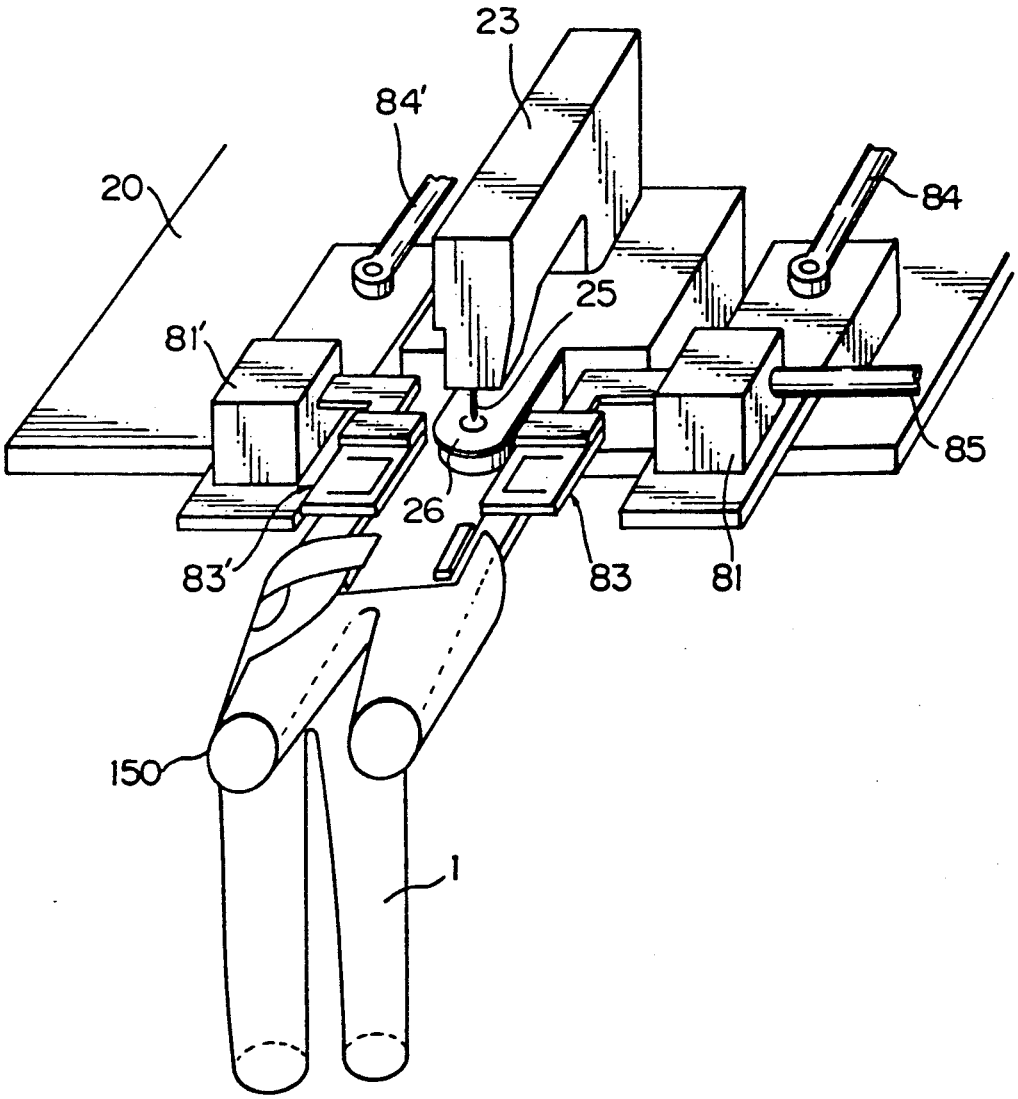
Figure 29:
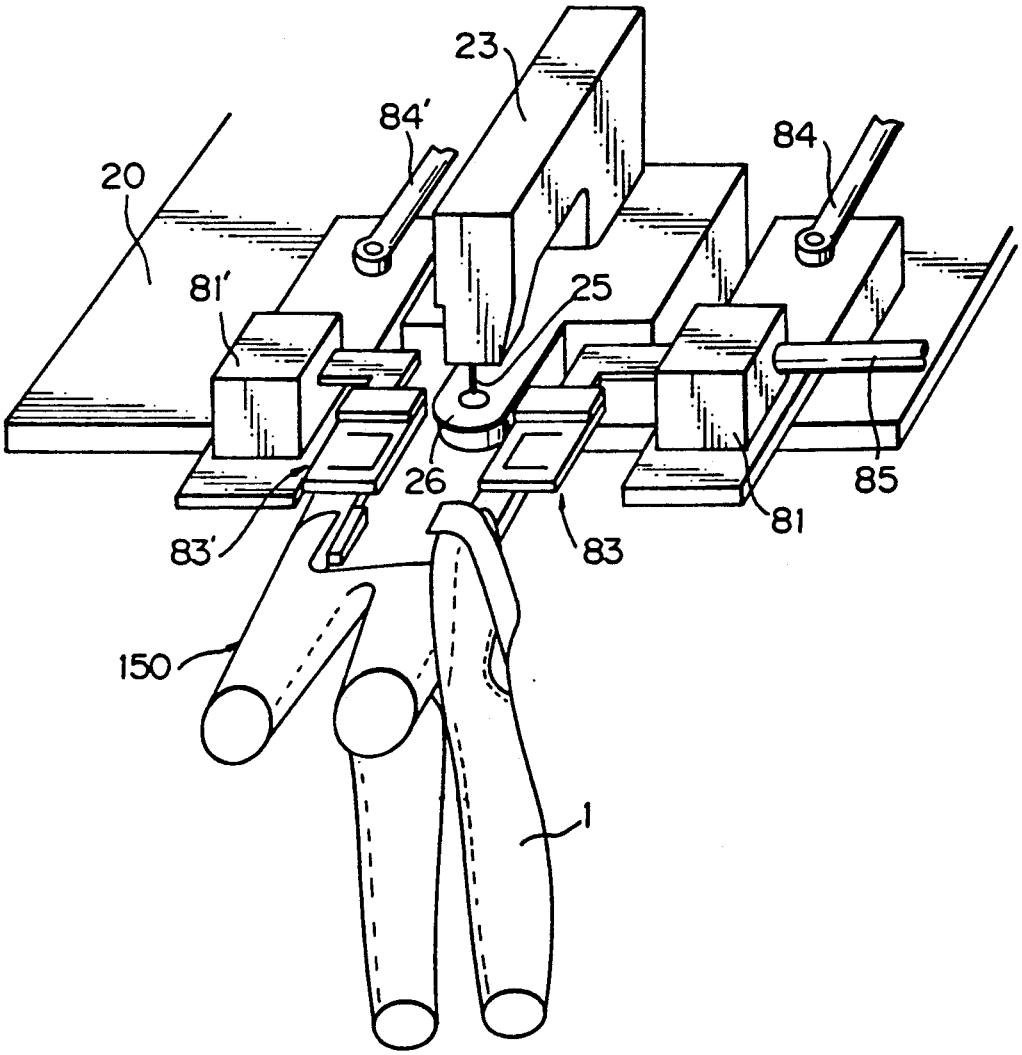

FIGS. 27, 28 and 29 are perspective views showing the supporting conditions of the jeans against a dummy.

DESCRIPTION OF THE PREFERRED EMBODIMENTS

One embodiment fo the present invention will be hereinafter explained in detail with reference to the attached drawings. First, FIGS. 4 to 7 show a sewing machine according to the present invention. This sewing machine comprises a base i0, a sewing device 21 installed on this base to sew material, and a pair of material setting/transfer assemblies 22, 22' mounted on the base.

Figure 1:
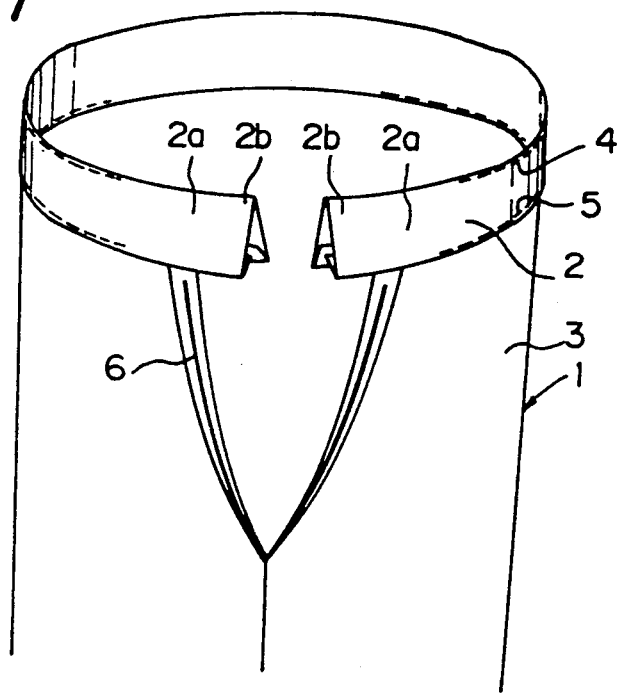
FIG. 1 is a perspective view partially showing jeans to be sewn by a sewing machine according to the present invention.

As shown in FIG. 1, although the sewing machine in this embodiment is so intended that tucking ends 2*b* of a waist belt 2 of jeans 1 are tucked in for forming tucked sewing portions 7, and that these tucked sewing portions and a body 3 are sewn together, the present invention is not restricted within this. It can also be applied to all the other sewing articles including such waist belts as used in trousers for suits.

Figure 4:
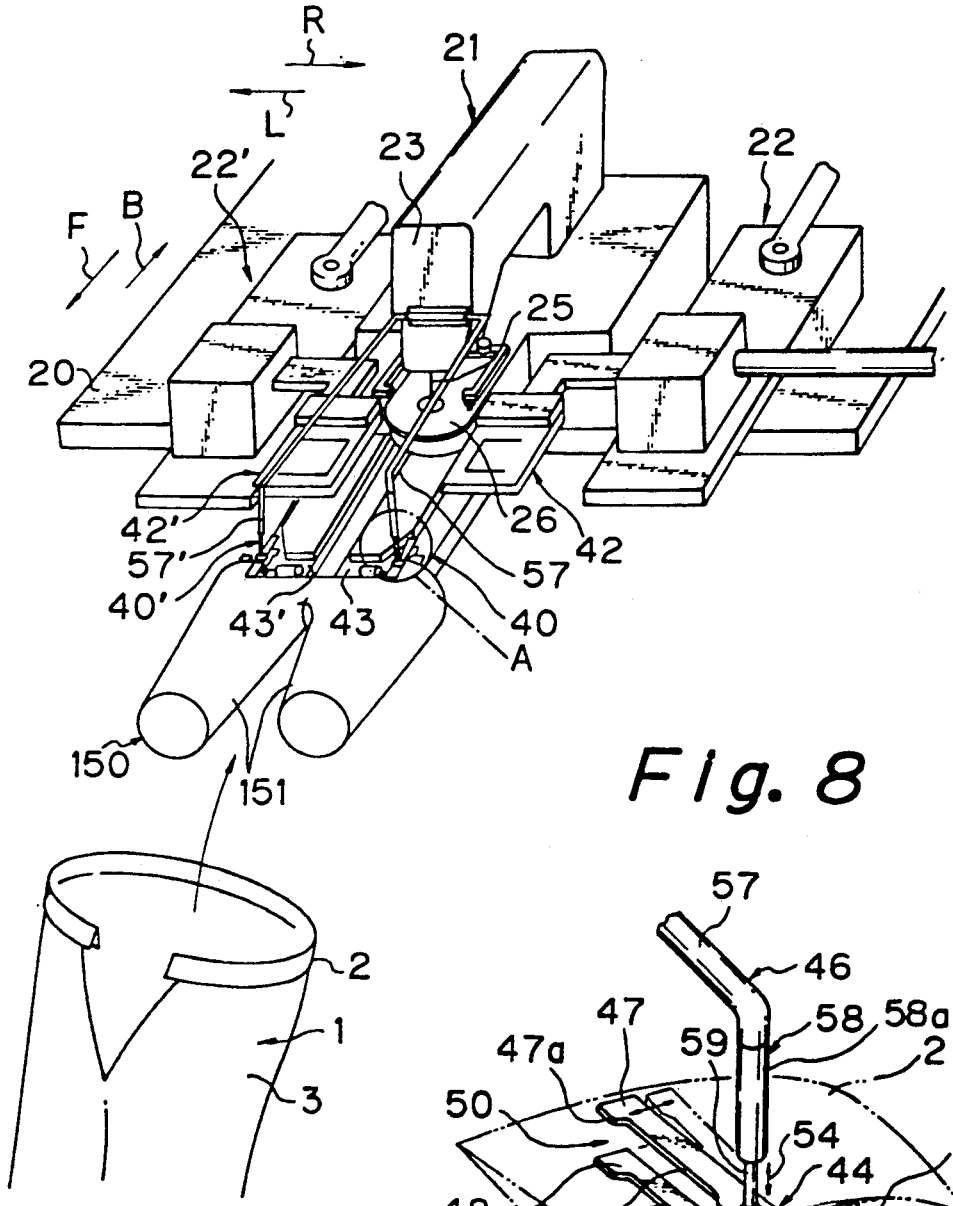
FIG. 4 is a perspective view showing a main body of the sewing machine according to the present invention.
Figure 5:
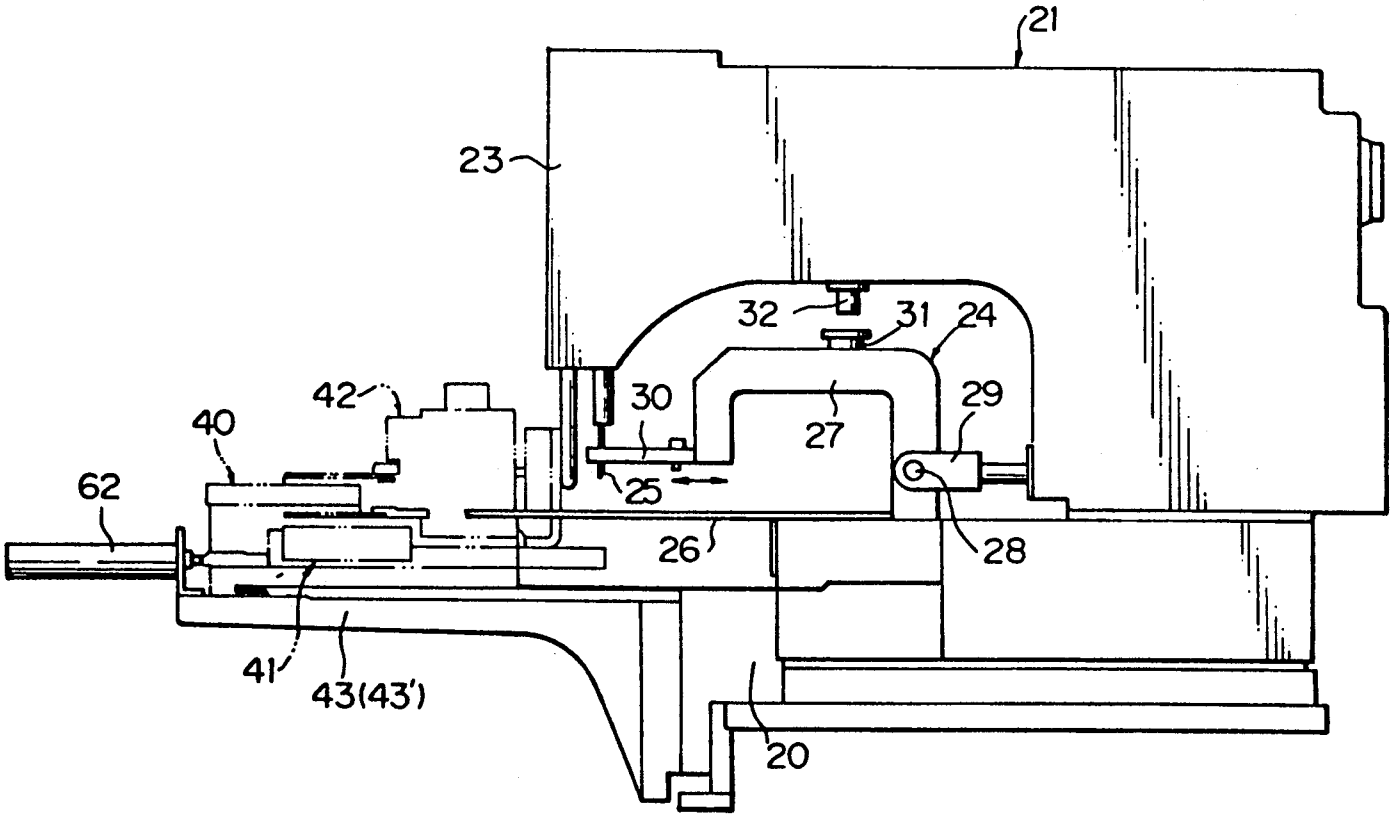
FIG. 5 is a side view showing the sewing machine of the present invention.

The sewing device 21 comprises a sewing head 23 and a sewing pattern guide mechanism 24 (see FIG. 5). The sewing head 23 is provided with a needle 25 and needle driving means (not shown) for reciprocatably moving this needle up and down. Below the needle 25 is located a needle plate 26 which is maintained horizontally and fixed securely on the base 20. Sewing mechanisms such as a bobbin case housing are provided beneath this needle plate. As illustrated in FIG. 4, the sewing pattern guide mechanism 24 is mounted on the base movably in a forward direction F, a backward direction B, a left direction L, and right direction R of the sewing machine. Those forward and backward directions F, B extend substantially perpendicular to these left and right directions L, R. The sewing pattern guide mechanism comprises a frame 27 and a supporting member 29 supporting this frame by means of a shaft 28 as shown in FIG. 5.

The frame 27 is set on the base 20 movably in the forward and backward directions F, B of the sewing machine, as indicated by an arrow in FIG. 5, and in the left and right directions L, R of the sewing machine which are perpendicular to those directions F. B. An arm 30 is attached on the front portion of the frame so as to support a holding cassette, which will be described belo. Such frame movements in the left and right directions L, R are along an axis line of the shaft 28. The movements of the frame in the forward and backward directions and the left and right directions of the sweing machine are performed by appropriate drive means, e.g., pulse motors (not shown). These pulse motors are controlled by control means (not shown). Such control means include a proper electrical circuit operating to sequence-control the tucking, transferring, and sewing processes of the sewing material as stated below, and to adjust this sequence-control for purposes of precision. These control means may be mounted on the base 20. Thus, the arm 30 is operated by the control means depending on an optional sewing pattern. In this embodiment, the arm is moved along a U-shaped pass for sewing substantially U-shaped binding regions of the tucked sewing portion 7 at opposite ends of the waist belt respectively. The arm is so attached on the frame 27 that it can be moved upwardly and downwardly, i.e., approaching to and retreating from the needle plate 26 by means of an arm driving device. This arm driving device comprises link means 31 (as partially shown in FIG. 5) located within the frame 27 and drive means for driving these link means, for instance, a solenoid 32. This solenoid is provided on the sewing head 23, as clearly shown in FIG. 5.

The material setting/transfer assemblies 22, 22' as a pair are respectively placed on the right and left sides of the sewing device 21 in symmetry. This arrangement enables the tucked sewing portions 7 at both ends of the waist belt 2 of the jeans 1 to be sewn continuously. That is to say, the material settling transfer assemblies are respectively operated in such a manner that each tucking end 2*b* of the waist belt 2 is tucked inside to extend beneath a portion to be sewn 2*a* for foming the tucked sewing portion 7, and that this tucked sewing portion is then conveyed to the sewing device.

Consequently, the respective tucked sewing portion at both ends of the waist belt can be automatically and continuously sewn so that a fast and efficient sewing operation is accordingly achieved.

Figure 6:
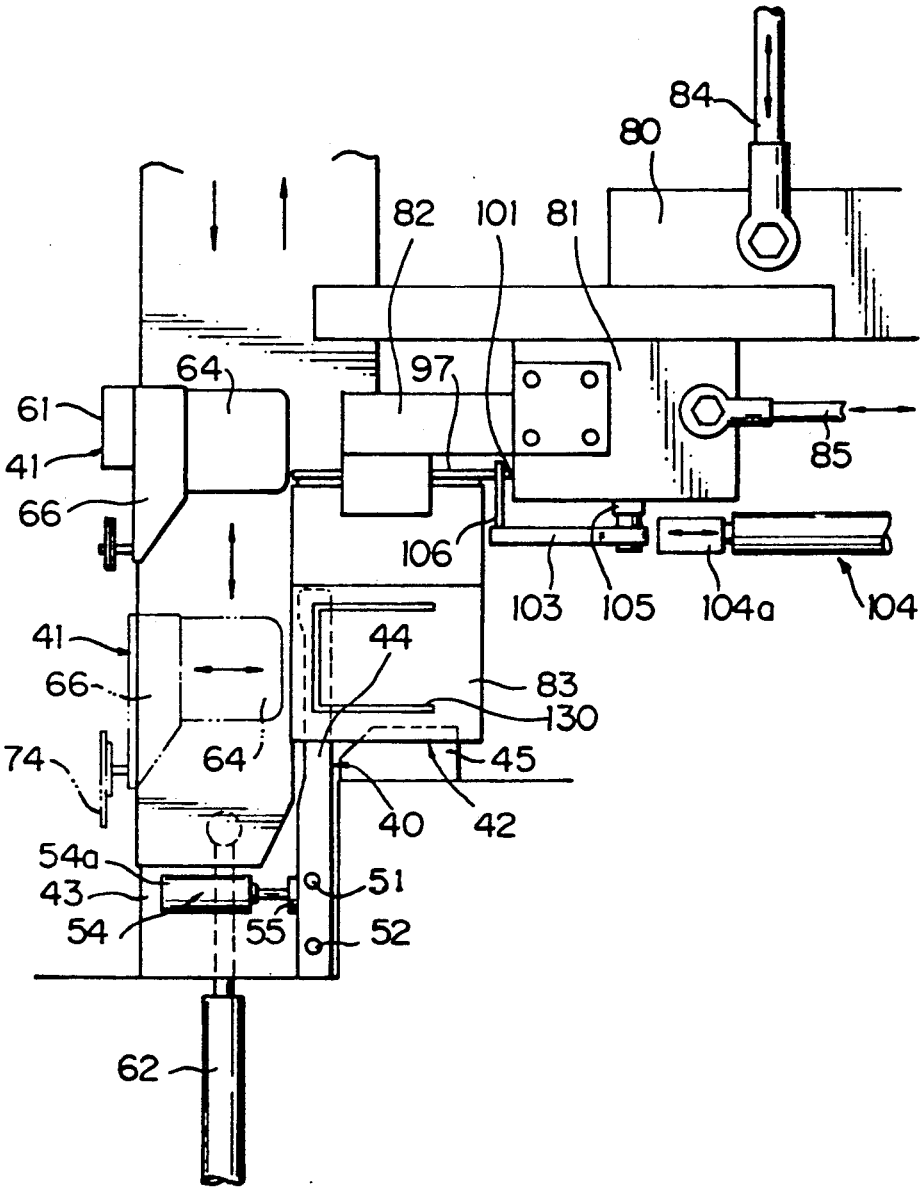
FIG. 6 is a plane view showing one of the material setting/transfer assemblies.
Figure 7:
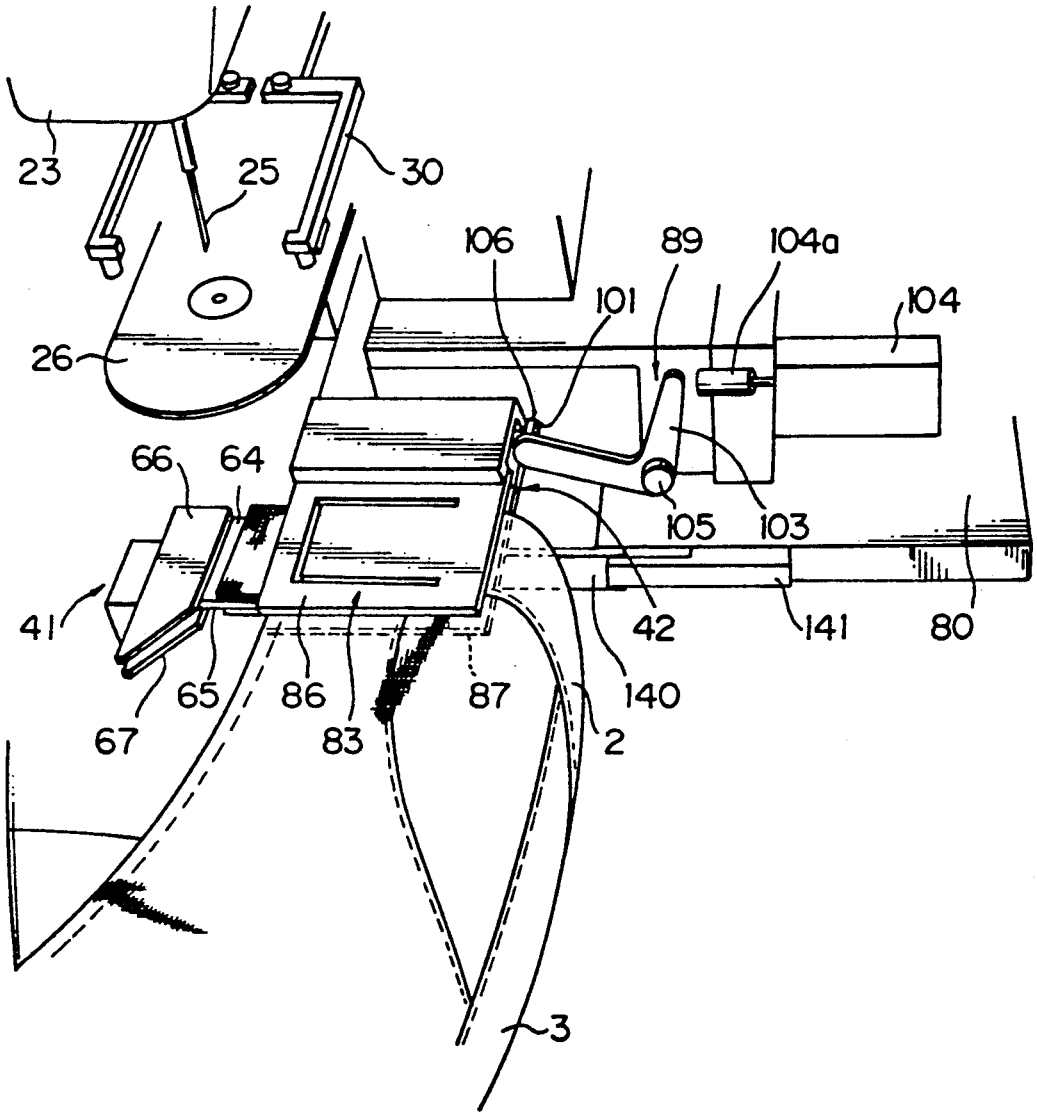
FIG. 7 is a perspective view of the assembly in FIG. 6.

Each of this pair of material setting/transfer assemblies 22, 22' comprises a sewing portion setting mechanism 40 for positioning the portion to be sewn 2a of the waist belt 2; a tuck-in mechanism or tucking means 41 for tucking the tucking end 2b so as to form the tucked sewing portion 7 (See FIGS. 6 and 7); and a transfer mechanism 42 for displacing this tucked sewing portion to the sewing device 21 (see FIGS. 4, 6 and 7). When the waist belt is tucked by the tucking means 41, the setting mechanism 40 and the transfer mechanism 42 constitute a gripper means for gripping a portion of the waist belt.

Since this right and left pair of material setting/transfer assemblies are symmetrical and identical to each other, only the right material setting/transfer assembly witll be explained hereinafter. For the sake of convenience, component parts of the left material setting/-transfer assembly which are identical with or symmetrical to component parts of the right assembly are denoted by the same reference numerals of the component parts of the right material setting/transfer assembly wth primes being placed after them.

The sewing portion setting mechanism 40 and the tuck-in mechanism 41 extend ahead of the needle 25 and are mounted on a supporting arm 43. The rear end of this supporting arm is pivotally connected to the front portion of the base 20 so that the fore end thereof can be swingably moved up and down. Although the supporting arm is securely fixed to the base usually horizontally by a lock means not shown, the fore end portion thereof can be moved down by releasing the lock means. When the supporting arm is thus moved down, the sewing portion setting mechanism and the tuck-in mechanism are displaced downwardly, thereby advantageously facilitating exchange of lower thread (a bobbin) which is received in the bobbin case housing positioned beneath the needle plat. The sewing portion setting mechanism 40 is constituted of a sewing portion setting holder 44, material positioning means 45, and material pressing means 46. The sewing portion setting holder 44 includes two elongated plates of a third member or an upper setting plate 47 and a first member or a lower setting plate 48, which are spaced one above the other substantially in parallel (see FIG. 8). These upper and lower setting plates have the proximal ends (the front ends) connected to a support block 49. In other words, as fully illustrated in FIG. 8, the lower surface of the upper setting plate 47 is located on the top face of the support block 49, while the upper surface of the lower setting plate is located on the bottom face of the support block 49. Accordingly, between this upper setting plate 47 and this lower setting plate 48 is formed a tuck-in space 50. The function of this tuck-in space will be described later. The upper setting plate, the support block, and the lower setting plate are fixed together by two pins 51, 52 or the like (see FIGS. 8 and 9).

Figure 8:
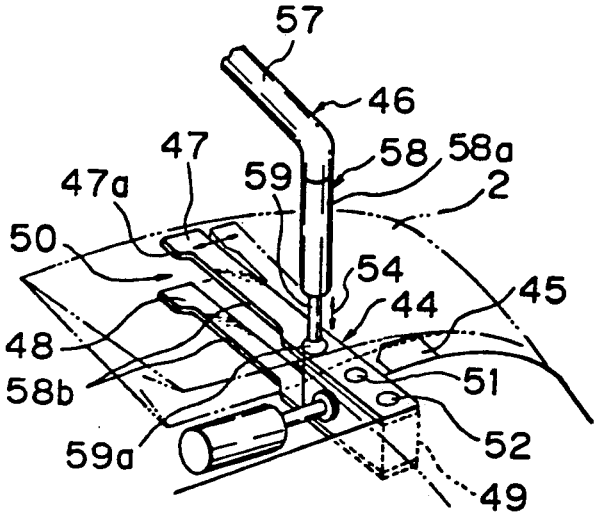
FIG. 8 is an enlarged perspective view of section A in FIG. 4.
Figure 9:
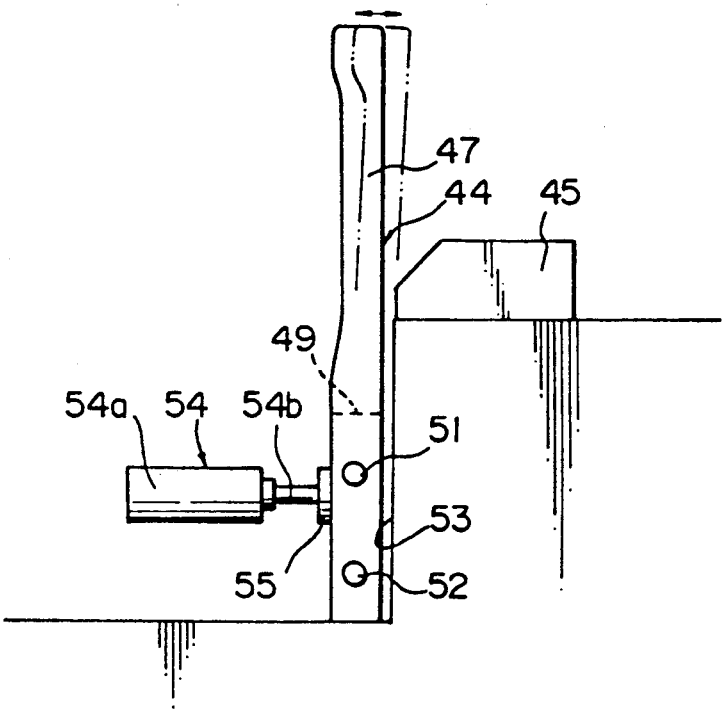
FIG. 9 is a plane view of the section in FIG. 8.

This sewing portion setting holder 44 is so designed that it can be horizontally swung around an axis of one pin of the two, e.g., the pin 52 in the left and right directions of the sewing machine (as indicated by arrows in FIGS. 8 and 9). In this case, the bottom end of the pin 52 protrudes downwardly, and this protruding part is rotatably received in a hole (not shown) formed in the supporting arm.

In order to set limits to the swinging movements of this sewing portion setting holder, restricter means are provided as shown in FIG. 9, and these restricter means comprise a stopper 53 formed on the supporting arm and an air cylinder 54, for instance, for forcing the sewing portion setting holder against this stopper. This air cylinder 54 includes a cylinder section 54a fastened on the supporting arm and a piston section 54b extending from this cylinder section. On the distal end of this piston section is provided a pad 55, which can be in contact with a side of the support block 49.

Therefore, as is clearly shown in FIG. 9, when the piston section 54b of the air cylinder 54 is extended to bring the pad 55 in contact with the side of the support block 49, the sewing portion setting holder 44 can be held stationary in the position indicated by a continuous line in FIG. 9. If the piston section 54b of the air cylinder 54 is retracted to detach the pad 55 from the side of the support block 49, the sewing portion setting holder 44 can be moved slightly clockwise into the position indicated by a chain double-dashed line in FIG. 9.

Figure 2:
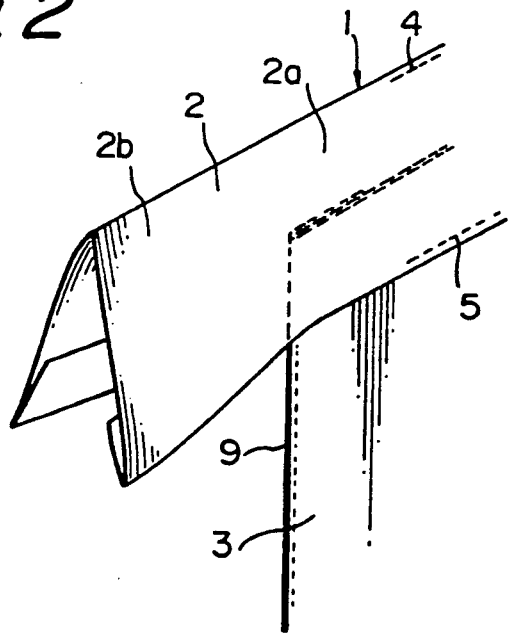
FIG. 2 is a perspective view showing the tucking ends of a waist belt.
Figure 3:
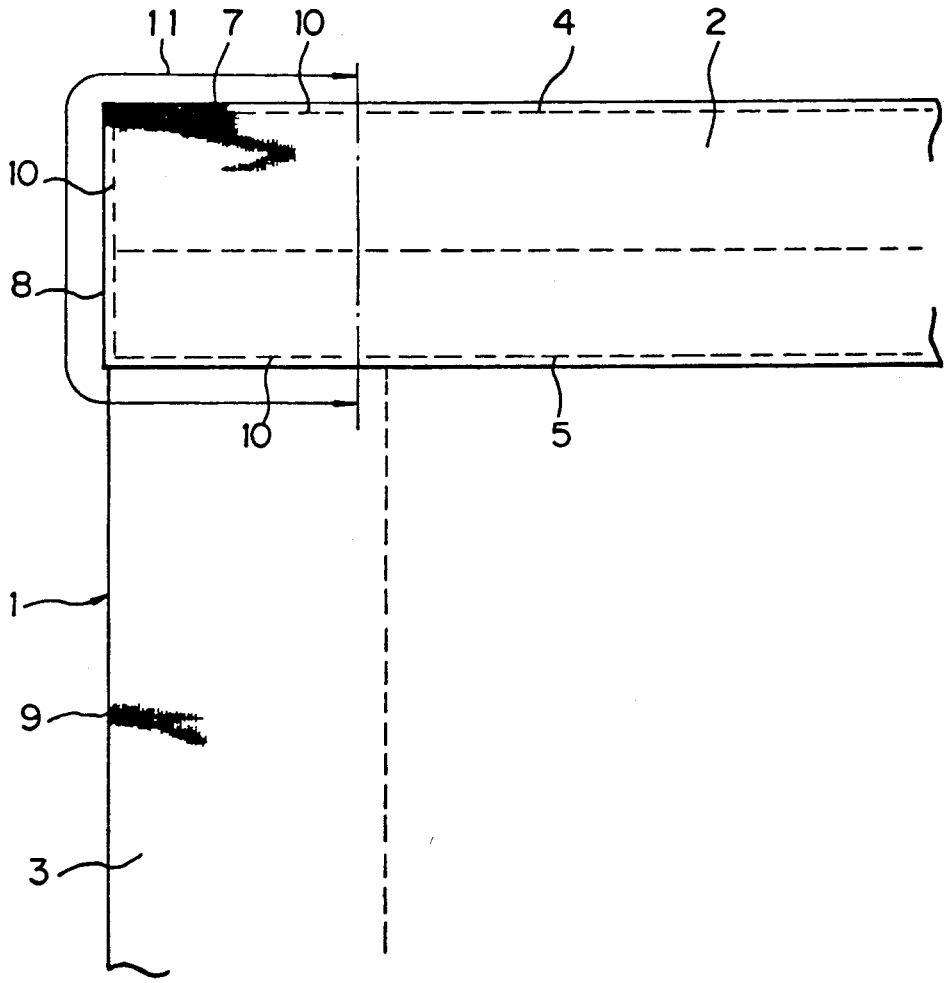
FIG. 3 is a side view partially showing a body of the jeans and the waist belt.

The portion to be sewn 2a as in FIGS. 1 and 2 is placed on this sewing portion setting holder. In this operation, the upper setting plate 47 is inserted between the upper fold of the double-folded waist belt 2 and the top surface of the body 3, while the lower setting plate 48 is inserted between the lower fold of the waist belt 2 and the bottom surface of the body 3. Then, a side end 9 of the body 3 is arranged to align with a recessed portion 58b of the upper setting plate 47.

As explained in detail later, the tuck-in mechanism 41 forces the tucking end 2b of the waist belt 2 into the tuck-in space 50 for tucking it in.

Inner side edges of the upper setting plate 47 and the lower setting plate 48 or the side edges which confront the tucking end 2b have the recessed portions 58b formed thereon, and these recessed portions serve to position a side edge 8 of the tucked sewing portion 7 in parallel with the side end 9 of the body 3 when the tucking end is tucked in.

Figure 10:
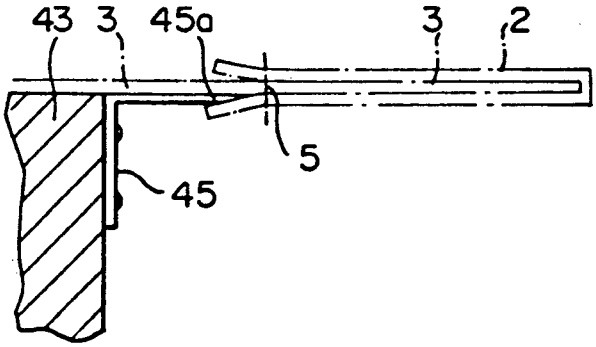
FIG. 10 is a side view of the material positioning means.
Figure 11:
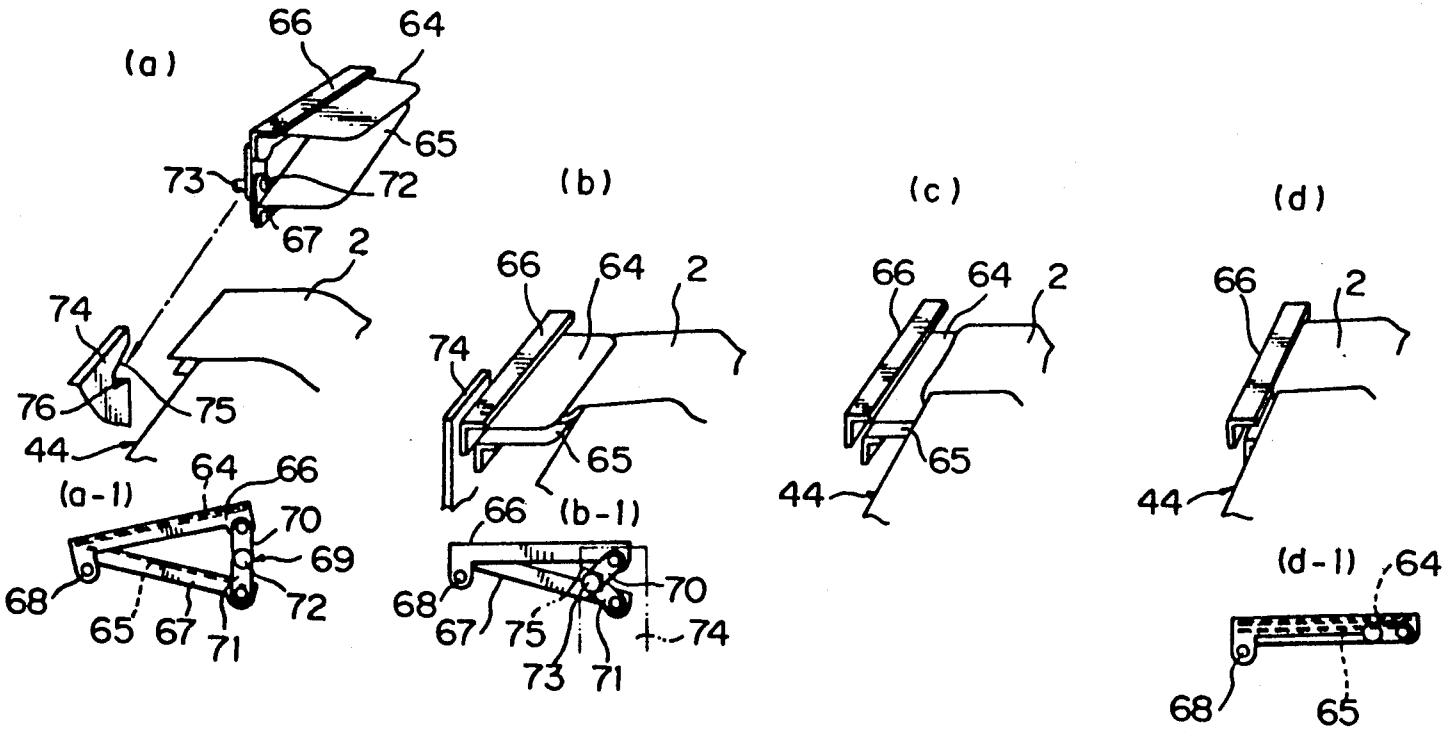

As illustrated in FIGS. 9 and 10; the material positioning means 45 comprise a positioning plate which is placed adjacent to the sewing portion setting holder 44 and fixed securely on the supporting arm 43. On the rear end of this positioning plate is provided a positioning edge 45a, which is to be engaged with sewing thread 5 on the lower side of the waist belt when the portion to be sewn 2a is placed on the sewing portion setting holder 44 (see FIG. 10). In this manner, the portion to be sewn 2a can be accurately positioned.

The material pressing means 46 are constituted of a supporting rod 57 and a pressing cylinder 58, as shown in FIGS. 4 and 8. One end of the supporting rod 57, i.e., its end portion located close to the needle 25 is fastened to a side plate of an end portion of the sewing head, while the other end of the supporting rod has the pressing cylinder 58 fixed thereto. This pressing cylinder comprises, for example, an air cylinder which includes a cylinder section 58a fixed to the supporting rod and a piston section 59 extending from this cylinder section. On the distal end of this piston section 59 is attached a pressing member 59a to press a suitable position of the sewing material placed on the sewing portion setting holder 44.

By means of these material pressing means, the sewing material is held on the sewing portion setting holder, and thus the operator does not have to hold the sewing material by hand. When the piston section 59 is extended, the pressing member 59a causes the waist belt to press on the upper setting plate 47.

The tuck-in mechanism 41 is fully illustrated in FIGS. 6, 7, 11 and 23 to 25. This tuck-in mechanism includes a first slider 60 set on the supporting arm 43 movably in the forward and backward directions of the sewing machine and a second slider 61 set on this first slider movably in the left and right directions of the sewing machine. The first slider 60 is moved in the forward and backward directions of the sewing machine by means of an air cylinder 62, for instance. The second slider 61 is displaced in the left and right directions of the sewing machine by means of an air cylinder 63 or the like (see FIGS. 23 to 25). More particularly, this air cylinder includes a cylinder section 63*a* and piston sections 63*b*. The cylinder section 63*a* is fastened on the first slider 60. The tips of the piston sections 63*b* have the second slider 61 securely fixed thereon. Accordingly, the extending/retracting function of the piston sections 63*b* enables the second slider 61 to move in the left and right directions of the sewing machine. In this manner, the tuck-in mechanism can be moved approaching to and retreating from the sewing portion setting mechanism 40.

The second slider 61 includes a pair of carrying plates 64, 65 to carry the tucking end 2*b*, as shown in FIGS. 6, 7, 11 and 23 to 25. These carrying plates are placed one above the other, with one side edge of the upper carrying plate 64 being secured to a supporting member 66 and one side edge of the lower carrying plate 65 being secured to a supporting member 67. One-side ends of these supporting members are interconnected pivotally by a pin 68, and this pin 68 is in turn pivotally connected to the second slider 61. The other-side ends of the supporting members are respectively joined by an appropriate link means, a toggle joint 69 being suitable for such a link means in the embodiment of the drawings. That is to say, this toggle joint comprises two links 70, 71, and one end of the link 70 is pivotally connected to the supporting member 66, while one end of the link 71 is pivotally connected to the supporting member 67. The other ends of these links 70, 71 are pivotally interconnected by a pin 72.

A driving device is provided for driving the pair of carrying plates 64, 65 to carry and release the tucking ends 2*b*. This driving device is constituted of a coiled spring (not shown) which is provided in a position neighboring the pin 68 so as to continuously bias the carrying plates 64, 65 open, and of closing means to close both the carrying plates 64, 65 against the force of this coiled spring. In this embodiment of the drawings, the closing means comprise a driven member 73 which extends from the pin 72 and a cam plate 74 with which this driven member is engaged. This cam plate is fastened to the supporting arm 43. The cam plate 74 has a cam groove 75 formed thereon, and this cam groove has a cam face 76 formed on the bottom surface. When the tuck-in mechanism 41 is displaced in the forward direction F of the sewing machine, the driven member 73 enters the cam groove 75 so as to be in touch with the cam face 76.

The pair of carrying plates 64, 65 are made of slightly elastic, relatively thin plates. Consequently, the tucking ends 2*b* can be easily and reliably inserted into the tuck-in space.

This tuck-in mechanism 41 for tucking the tucking ends 2*b* is first moved from the initial position indicated by a continuous line in FIG. 6 in the forward direction F of the sewing machine by means of the air cylinder 62. In accordance with this movement, the driven member 73 is brought in touch with the cam face 76 so as to gradually close the carrying plates 64, 65 (see FIG. 11*b*), and when the tuck-in mechanism is displaced to a position substantially aligned with that of the sewing portion setting holder 44 (as indicated by a chain double-dashed line in FIG. 6), the tucking ends 2*b* are completely carried by the carrying plates 64, 65. This position is hereinafter referred to as the carriage position.

In this case, it should be noticed that the other-side ends of the carrying plates 64, 65 are caused to approach each other gradually by means of the toggle joint 69 in order to carry the tucking ends. As a result, the sewing material can be carried in an extremely smooth and reliable manner.

The tuck-in mechanism is displaced from this carriage position in the right direction R of the sewing machine, i.e., toward the sewing portion setting holder 44 (see FIG. 12*c*). As a matter of course, the tucking ends 2*b* continue to be carried by the carrying plates 64, 65 during this operation.

When the tuck-in mechanism is further moved to the right, the carrying plates 64, 65, which continue to carry the tucking ends therebetween, enter the tuck-in space 50 of the sewing portion setting holder 44, and then pass through this tuck-in space (see FIGS. 11*d* and 12*d*), in order to reach a tucking position. In this condition, the tucking ends 2*b* are tucked in. Thus, the tucking ends are folded so as to sufficiently extend beneath the portion to be sewn 2*a*, thereby forming the tucked sewing portion 7.

The transfer mechanism 42 comprises a first bed 80 set on the base 20 movably in the forward and backward directions F, B of the sewing machine and a second bed 81 set on this first bed movably in the left and right directions L, R of the sewing machine (see FIG. 6). This second bed 81 has a coupling member 82 attached thereto, and on this coupling member is detachably provided a holding cassette 83 for holding the tucked sewing portion 7.

The first bed 80 is driven in the forward and backward directions by means of an air cylinder 84 or the like, while the second bed 81 is driven in the left and right directions by means of an air cylinder 85 or the like.

The structure of the holding cassette 83 is fully illustrated in FIGS. 17 to 19. The holding cassette in this embodiment of the drawings comprises a fourth member or an upper holding plate 86 and a second member or a lower holding plate 87 extending in parallel with each other; link means 88 for displacing these upper and lower holding plates close to and away from each other in parallel; and drive means 89 for relatively driving the upper and lower holding plates. More particularly, the upper holding plate 86 is secured to an upper supporting member 90, where as the lower holding plate 87 is secured to a lower supporting member 91. An intermediate supporting member 92 is placed between these upper and lower supporting members 90, 91. The bottom ends of two shafts 93 are securely fixed onto the lower supporting member 91. These shafts extend through the intermediate supporting member 92 so as to be inserted through ball gauges 95 into bushes 94 fastened on the upper supporting member 90. Accordingly, the upper holding plate 86 can be smoothly moved along the shafts 93 in parallel with the lower holding plate 87 approaching to and retreating from it. When the upper holding plate 86 approaches the lower holding plate 87, the tucked sewing portion can be carried between these plates, and when the upper holding plate retreats from the lower holding plate, this tucked sewing portion can be released. Material pressing members 96 may be respectively provided on the opposite surfaces of the upper holding plate and the lower holding plate.

The link means 88 in this embodiment of the drawings includes a lever 97. A substantially central portion of this lever is rotatably attached to the intermediate supporting member 92 by a stepped pin 98. One end of this lever 97 is formed with an elliptic hole 97*a*, to which a pin 99 fastened on the upper supporting member 90 is inserted, while the other end of the lever is likewise formed with an elliptic hole 97*b*, to which a pin 100 fastened on the lower supporting member 91 is inserted. The other-end portion of this lever has a projection 101 extending therefrom (see FIGS. 18 and 19).

The drive means 89 in this embodiment of the drawings are constituted of a coiled spring 102 for biasing the upper holding plate 86 toward the lower holding plate 87 to continuously close both of them, and means for forcing the projection 101 against the force of this coiled spring so as to retreat the upper holding plate 86 from the lower holding plate 87 to cause both of them to open. Such opening means, as shown in FIGS. 6 and 7, include an L-shaped crank 103 whose substantially central portion is pivotally connected to the second bed 81 and an air cylinder 104 for operating this L-shaped crank. This substantially central portion of the L-shaped crank 103 is connected to the second bed 81 by means of a pin 105, and one end of this L-shaped crank 103 has an axis 106 securely fixed thereto, which may be engaged with the projection 101. The distal end of a piston rod 104*a* of the air cylinder 104 may be engaged with the other end of the L-shaped crank 103. Consequently, when the piston rod 104*a* of the air cylinder 104 is extended from a condition of FIG. 7, the L-shaped crank is rotated counter-clockwise as seen in FIG. 7, and the axis 106 forces down the projection 101 of the lever 97 so that the upper holding plate 86 can be moved up against the coiled spring 102 so as to retreat from the lower holding plate 87. Accordingly, when the piston rod 104*a* is extended, the upper and lower holding plates 86 and 87 are moved away from each other to release the waist belt. When the piston rod 104*a* is retracted, the upper and lower holding plates 86 and 87 are moved toward each other under the force of the coiled spring 102 to grip the waist belt.

For reference, the above-described coiled spring 102 is received in a stepped portion of the stepped pin 98.

This holding cassette 83 is detachably connected to the coupling member 82 by a suitable connecting means (not shown). This coupling member 82 is attached to the second bed 81 for moving vertically, as illustrated in FIG. 20. More particularly, on the second bed 81 is formed a groove 81*a* extending vertically, and the coupling member 82 has a protrusion 82*a* formed thereon which is smoothly inserted into this groove. As a result, the coupling member with the holding cassette attached thereto can be moved vertically with respect to the second bed by its own weight.

Positioning of this holding cassette 83 above the needle plate 26 is performed by the air cylinder 85 which displaces the second bed 81. Then, when the connecting means are released, the holding cassette is detached from the coupling member 82 and placed on the needle plate.

A guide mechanism is provided for positioning the holding cassette 83 on the needle plate 26, and this guide mechanism comprises a cam 110 fastened on the base 20 and a roller 111 attached to the coupling member 82, as shown in FIG. 20. The cam 110 is provided with a cam face 112, with which the roller 111 is engaged so that it can roll on the cam face. This cam face not only extends along the left and right directions of the sewing machine, but also includes a surface inclining smoothly downwardly from a position far from the needle plate 26 to a position close to the needle plate so that the holding cassette 83 is gradually moved down as it approaches the needle plate 26. Therefore, when the second bed 81 is displaced toward the left of the sewing machine, the holding cassette 83 approaches the needle plate, and simultaneously it is diagonally moved down toward the surface of the needle plate by its own weight until it is placed on the needle plate.

Thus, the holding cassette can be reliably mounted on the needle plate.

Holding cassette positioning means are provided for positioning the holding cassette at a predetermined position on the needle plate, and the holding cassette positioning means in this embodiment of the drawings are constituted of at least two positioning bushes 120 which may be secured on the upper supporting member 90 of the holding cassette; positioning pins 121 fixed on the arm 30 of the sewing device 21 so that they can be inserted to these positioning bushes; and holding cassette pressing members 122 attached to the bottom surface of the arm 30.

The positioning bushes 120 are located at the rear side of the holding cassette and spaced along the left and right directions of the sewing machine, and the positioning pins 121 are located at the rear side of the arm 30 and opposite to the positioning bushes. The holding cassette pressing members 122 are placed at the front of the arm and spaced along the left and right directions of the sewing machine. Consequently, when the holding cassette is positioned on the needle plate, the arm 30 is pushed down by the arm driving device, and then the positioning pins 121 of the arm are inserted to the positioning bushes 120 of the holding cassette, with the holding cassette pressing members 122 simultaneously pressing the upper surface at the front portion of the holding cassette. Faces of the holding cassette pressing members 122 in contact with the holding cassette are contacted with the upper surface and both of the left and right end surfaces of the holding cassette. In this manner, the holding cassette is reliably positioned at the predetermined position on the needle plate, and besides, the tucked sewing portion can be pressed equally because the pressure is distributed to the four spots of 121, 121, 122, 122.

The upper holding plate 86 and the lower holding plate 87 have U-shaped openings 130 formed thereon. These U-shaped openings correspnd to the U-shaped sewing pattern for sewing the border of the tucked sewing portion 7.

The needle 25 can enter these U-shaped openings.

Figure 12:
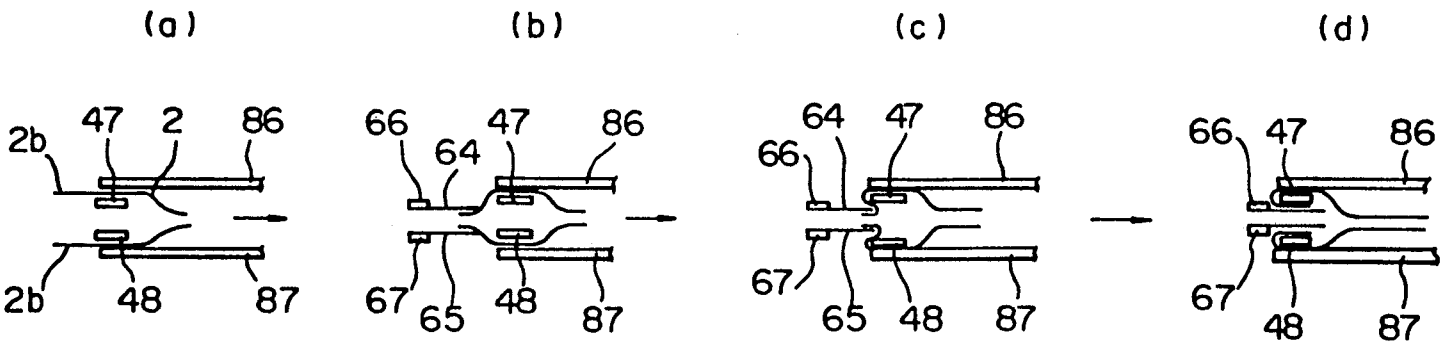

This holding cassette is located at the sewing portion setting holder 44 during the tucking operation by the tuck-in mechanism 41 (see FIGS. 6, 7 and 12). In this operation, as fully illustrated in FIGS. 12*a* to 12*d*, the upper holding plate 86 holds the upper fold of the waist belt between itself and the upper setting plate 47 of the sewing portion setting holder 44, while the lower holding plate 87 holds the lower fold of the waist belt between itself and the lower setting plate 48 of the sewing portion setting holder. Thus, the tucking operation can be performed far more precisely.

After the above-described tucking operation has been completed by the tuck-in mechanism 41, the transfer mechanism 42 conveys this tucked sewing portion to the sewing device 21. In order to detach the tuck-in mechanism 41 from the sewing portion setting holder 44 without releasing the tucked sewing portion during this operation, follow-up means are provided for detaching the transfer mechanism 42 together with the tuck-in mechanism from the sewing portion setting holder, these follow-up means being clearly seen in FIGS. 23 to 25. Such follow-up means comprise a connecting shaft 140 securely fixed to the second slider 61 of the tuck-ion mechanism 41 and an engagement plate 141 fastened on the first bed 80 of the transfer mechanism 42. As shown in FIG. 24, the connecting shaft 140 is engaged with the engagement plate 141 when the tuck-in mechanism 41 is located at the tucking position and the transfer mechanism 42 is located at the sewing portion setting holder 44. In this condition, as in FIG. 25, the transfer mechanism 42 is moved toward the back of the sewing machine, so that the tucked sewing portion can be conveyed to the sewing device 21. and then the tuck-in mechanism 41 is also moved in accordance with the transfer mechanism 42.

As a result, the tucked sewing portion, which continues to be held by the tuck-in mechanism 41 and the transfer mechanism 42, can be detached form the sewing portion setting holder 44, so that the tucked sewing portion may not be left unsewn nor turned over.

Incidentally, the air cylinder 62 of the tuck-in mechanism 41 is emptied of its air in this operation.

FIG. 26 shows the respective locations of the air cylinders in the material setting/transfer assemblies as a pair. These air cylinders are sequence-operated by control means. These control means are connected by foot pedals (not shown) which the operator can operate.

As illustrated in FIG. 4, another characteristic of the present invention is that a material supporting mechanism 150 is installed. This material supporting mechanism is securely fixed to the base 20 by means of the supporting arm 43 at the very front of the sewing machine. This mechanism serves to support the sewing material, i.e., the whole material of the jeans 1 in this embodiment. This material supporting mechanism includes support faces 151 whose configurations correspond to those of the material to be sewn. The material supporting mechanism in this embodiment of the drawings is formed of a dummy whose shape roughly corresponds to that of the jeans 1, i.e., whose shape is similar to that of the waist to the femoral region of the human body.

The jeans 1 are supported as a whole when placed on the dummy. By supporting the jeans in this way, the sewing material will not be allowed to move out of position or fall off the sewing machine during the tucking, transferring, and sewing operations.

FIGS. 27 to 29 show various methods of supporting the jeans against the dummy.

In one method illustrated in FIG. 27, two pairs of the jeans 1', 1" are set on the dummy by hanging them on both sides of the dummy instead of dressing the dummy with them. This method is effective when it is employed for trousers of small sizes and the like which cannot be set on the dummy.

Another method shown in FIG. 28 can be employed for tucking only the button side (left) of the waist belt into one pair of the jeans 1.

The other method in FIG. 29 can be used for tucking only the eyelet side (right) of the waist belt in one pair of the jeans 1.

In the above sewing machine, the operations are continuously performed by control means (not shown). The operator can carry out the operations by means of the foot pedals (not shown).

Next, the application conditions will be briefly outlined. The jeans 1 for sewing are first set by dressing the dummy 150 with them, as clearly shown in FIG. 4. Then, the portions to be sewn **2*a* at both ends of the waist belt are respectively mounted on the sewing portion setting holders 44, 44' at the right and left sides. Thus, the upper setting plate 47 of the right setting holder 44 is inserted between the upper side of the body 3 of the jeans 1 and the upper inside of the eyelet end of the portion 2*a* to be sewn. The lower setting plate 48 is inserted between the lower side of the body 3 of the jeans 1 and the lower inside of the eyelet end of the portion 2*a* to be sewn. The setting plates of the left setting holder 44' are similarly positioned relative to the button end of the portion 2*a* to be sewn. After that, by operating the foot pedals, the material pressing means 46, 46' at both sides press the sewing material against the sewing portion setting holders, while the right and left transfer mechanisms 42, 42' are moved to the sewing portion setting holders 44, 44' so that the upper holding plates 86, 86' and the lower holding plates 87, 87' of the holding cassettes 83, 83' can securely hold the waist belt 2 on the sewing portion setting holders. The right and left tuck-in mechanisms 41, 41' are next displaced to the carriage positions for carrying the tucking ends 2*b* and tucking these tucking ends 2*b* at both ends of the waist belt in order to form the tucked sewing portions respectively. Then, the right and left transfer mechanisms 42, 42' are moved back toward the sewing device 21. During this operation, the transfer mechanisms 42, 42' detach the tuck-in mechanisms 41, 41' from the sewing portion setting holders 44, 44', continuing to carry the tucked sewing portions. After that, the right and left transfer mechanisms 42, 42' are further moved backwardly with the holding cassettes holding the tucked sewing portions. Next, the tuck-in mechanisms 41, 41' are moved away the transfer mechanisms 42, 42'. For reference, the dummy 150 remains stationary since it is fixed to the base 20. Next, one of the right and left holding cassettes is moved toward the needle plate and mounted on it. Then, this holding cassette is positioned by the arm. So far the holding cassettes have continuously held the respective tucked sewing portions of the waist belt. When one of the holding cassettes is thus positioned by the arm, this holding cassette is detached form the coupling member. After this operation, the second bed is returned to its home position. The sewing pattern guide mechanism 24 is then moved according to the U-shaped sewing pattern, and one of the tucked sewing portions 7 is sewn along the U-shaped by means of the needle 25. After this sewing operation has been completed, the second bed approaches the holding cassette again for receiving the holding cassette on its coupling member and returns to its home position. As the next step, the other holding cassette is displaced to the other needle plate 26' and positioned by the arm, thereby causing the tucked sewing portion 7** on the other side to be likewise sewn in the above manner. And it is also followed by the same operations as previously explained.

As fully described above, both ends of the waist belt of the jeans can be tucked in, transferred, and sewn automatically.

According to the present invention as previously explained, a pair of material setting/transfer assemblies are provided on the right and left sides of a sewing machine, each of which assemblies comprises a sewing portion setting mechanism, a tuck-in mechanism, and a transfer mechanism, so that the setting, tucking, transferring, and sewing operations of the sewing material can be automatically carried out, thereby causing the efficiency of the operations to remarkably increase. Moreover, because the tucking and transferring operations can be performed automatically, there is brought about such practical effect that the tucking operation can ben readily managed without a high level of skill, and that the transferring operation can also be carried out rapidly and precisely.

What is claimed is:

1. An apparatus for use in forming the waist belt of a pair of trousers, said apparatus including a sewing head for sewing the waist belt of the trousers after an end portion of the waist belt has been tucked into the waist belt, setting means insertable into the waist belt of the trousers to position the waist belt of the trousers prior to tucking of the end portion of the waist belt into the waist belt, tuck-in means insertable into the waist belt while the waist belt is engaged by said setting means to tuck an end portion of the waist belt into the waist belt, holder means engageable with upper and lower outer side surfaces of the waist belt to grip the waist belt, and drive means for providing relative movement between said setting means, tuck-in means and holder means to disengage said setting means and tuck-in means from the waist belt and to move the waist belt and holder means to said sewing head while maintaining a continuous grip on the waist belt with said holder means.

2. An apparatus as set forth in claim 1 wherein said setting means includes an upper and lower setting plates which are spaced apart from each other and are insertable into the waist belt, said holder means including upper and lower holding plates which are engageable with upper and lower outer side surfaces of the waist belt to grip opposite sides of the waist belt between said upper and lower setting plates and said upper and lower holding plates, said tuck-in means being insertable into space between said upper and lower setting plates to tuck an end portion of the waist belt into the waist belt while the waist belt is gripped between said upper and lower setting plates and said upper and lower holding plates.

3. An apparatus as set forth in claim 1 wherein said drive means is operable to move to provide relative movement between said setting means, tuck-in means and holder means to disengage said setting means from the waist belt while said tuck-in means is in engagement with the waist belt, said drive means being operable to move said tuck-in means and holder means together toward said sewing head with the waist belt clamped between said tuck-in means and holder means after disengagement of said setting means from the waist belt.

4. An apparatus as set forth in claim 3 wherein said drive means is operable to provide relative movement between said tuck-in means and holder means to disengage said tuck-in means from the waist belt after disengagement of said setting means from the waist belt, said drive means being operable to continue movement of said holder means toward said sewing head with the waist belt gripped by said holder means after disengagement of said setting means and tuck-in means from the waist belt.

5. An apparatus as set forth in claim 4 wherein said sewing head includes means for sewing the waist belt while the waist belt is gripped by said holder means and after disengagement of said setting means and tuck-in means from the waist belt.

6. An apparatus as set forth in claim 1 wherein said drive means includes means for disengaging said tuck-in means and setting means from the waist belt while the waist belt is gripped by said holder means, said sewing head including means for sewing the waist belt while the waist belt is gripped by said holder means after disengaging said tuck-in means and setting means from the waist belt.

7. An apparatus as set forth in claim 6 wherein said holder means includes surface means defining in said holder means an opening through which a needle is movable during sewing of the waist belt by said sewing head.

8. An apparatus as set forth in claim 1 wherein said holder means includes upper and lower holding plates, mounting means for enabling relative movement to occur between said upper and lower holding plates, and spring means connected with said upper and lower holding plates for urging said upper and lower holding plates toward each other to enable said holder means to maintain a continuous grip on the waist belt from the time when said holder means engages the waist belt until after the waist belt is sewed by said sewing head.

9. An apparatus as set forth in claim 8 wherein said sewing head includes means for applying force against said holder means to increase the force urging said upper and lower holding plates toward each other during sewing of the waist belt by said sewing head.

10. An apparatus as set forth in claim 9 wherein said upper and lower holding plates have surface means for defining openings having a configuration corresponding to a seam to be sewn into the waist belt by said sewing head to enable a needle to extend through said upper and lower holding plates during sewing of the waist belt by said sewing head.

11. An apparatus as set forth in claim 8 further including means for moving at least one of said upper and lower holding plates against the influence of said spring means to release the waist belt after sewing of the waist belt by said sewing head.

* * * * *